United States Patent [19]

Scarnecchia

[11] 4,148,346

[45] Apr. 10, 1979

[54] METHOD OF AND APPARATUS FOR DRYING AND DEBARKING LOGS

[76] Inventor: O. Vincent Scarnecchia, 3271 Amelia Dr., Mohegan Lake, N.Y. 10547

[21] Appl. No.: 695,933

[22] Filed: Jun. 14, 1976

[51] Int. Cl.[2] ..... B27L 1/00

[52] U.S. Cl. ..... 144/311; 34/1; 204/180 R; 144/1 R; 144/208 R; 144/327; 219/10.81

[58] Field of Search ..... 204/180 R, 300 R, 181, 204/182; 144/1 R, 3 R, 208 R, 311, 309 R, 327; 34/1 R; 219/10.81

[56] References Cited

U.S. PATENT DOCUMENTS

| | | | |
|---|---|---|---|
| 2,582,806 | 1/1952 | Nes et al. | 34/1 |
| 2,899,993 | 8/1959 | Durant | 144/208 R |
| 3,404,462 | 10/1968 | Hanson et al. | 31/1 |
| 3,426,439 | 2/1969 | Ryman et al. | 34/1 |
| 3,456,356 | 7/1969 | Malmquist | 34/1 |
| 3,474,544 | 10/1969 | Holden, Jr. et al. | 34/1 |
| 3,537,185 | 11/1970 | Ingram | 34/1 |
| 3,555,695 | 1/1971 | Dunn, Jr. | 34/1 |
| 3,705,819 | 12/1972 | Heller, Jr. et al. | 34/1 |
| 3,754,584 | 8/1973 | Bumerl | 144/208 R |
| 3,953,701 | 4/1976 | Manwaring | 219/10.81 |
| 3,977,937 | 8/1976 | Candor | 204/300 R X |

*Primary Examiner*—Othell M. Simpson
*Assistant Examiner*—W. D. Bray
*Attorney, Agent, or Firm*—David M. Broudy

[57] ABSTRACT

A method of and apparatus for removing bark from a log or cant. The cant is fed via an infeed section which eliminates limbs to a two-stage drier section in which a radial frequency generator with plate electrodes creates an electrical field in the cant to heat the moisture therein by dielectric means. In the second stage a concentrated electrical field is applied to the bark area by oval electrodes to produce a gas buildup between the cambium and the bark to cause partial separation of the bark. The drier section is followed by a three-stage debarking section, with brushes in the first stage for removing loose, large bark pieces, with crusher heads in the second stage to loosen, raise and flake the remaining bark without damaging the wood, and a final brush section for removing rough edges and create a smooth finish.

9 Claims, 29 Drawing Figures

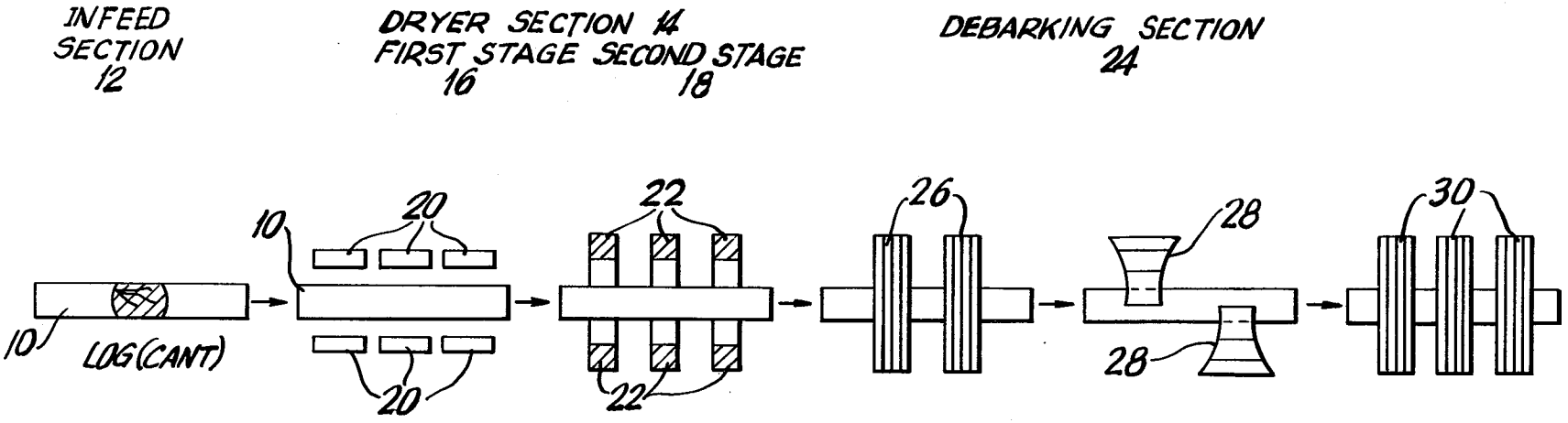
FIG. 1
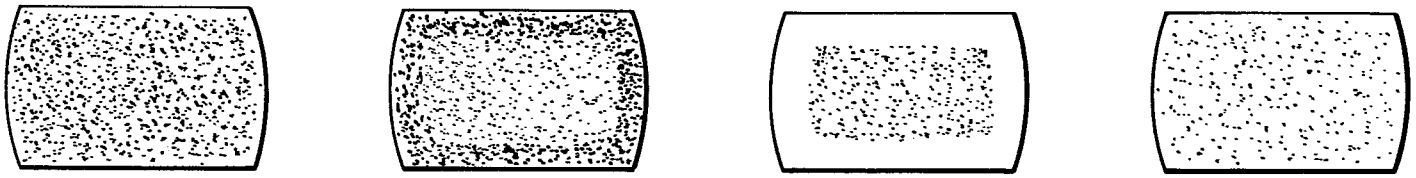
FIG. 19a
FIG. 19b
FIG. 19c
FIG. 19d

METHOD OF AND APPARATUS FOR DRYING AND DEBARKING LOGS

BACKGROUND OF THE INVENTION

The present invention relates to a method of and apparatus for drying and debarking logs, or more specifically, cants, that is logs that have been preprocessed by cutting them longitudinally on opposite sides while leaving the remaining surface untouched. Thus, the cross-section of the cant is substantially circular but with two flat sides. Such cants are used frequently, but not exclusively, for building log cabins or houses. It should be understood that while the following description specifically refers to cants it is equally applicable to round logs, or wood of square cross-section such as railroad ties.

Prior art methods and apparatus for drying and debarking logs and cants are cumbersome and require a great amount of time and energy and are not suitable for a continuous or in-line operation.

It is, therefore, an object of the present invention to provide an efficient method and machine for drying and debarking wood, especially logs and cants. More specifically, the invention aims at reducing the amount of time for drying and removing bark from logs or cants, to several minutes instead of days that is presently required in kiln drying.

It is another object of this invention to provide a relatively compact and efficient machine in which all operations from the removal of small tree limbs to the completely dried and smooth-finish cant can be accomplished in a continuous, in-line fashion.

BRIEF SUMMARY OF THE INVENTION

One of the main features of the present invention is the provision of a radial-frequency (R-F) generator for drying the logs or cants by dielectric heating. Debarking of the logs or cants is accomplished by partial ionization between the wood and the bark to cause partial delamination of the bark from the wood, and by a crushing and brushing action.

The debarking action is also accomplished by a concentrated field effect which, while not degrading the wood, causes decomposition in the bark fiber.

The method of drying and debarking according to the present invention produces an aesthetic appearance of the cant or log. It permits the cambium to remain on the wood thereby producing a unique finish that is very desirable in a number of applications, or optionally to remove the cambium along with the bark.

BRIEF DESCRIPTION OF THE DRAWING

The invention is illustrated by way of example in the attached drawing, in which:

FIG. 1 is a schematic representation of the cant dryer and debarking apparatus according to the present invention;

FIGS. 19*a* to 19*d* are cross-sections through a cant being processed in the dryer section, showing the distribution of moisture in the cant;

DETAILED DESCRIPTION OF A PREFERRED EMBODIMENT

Figure 2:
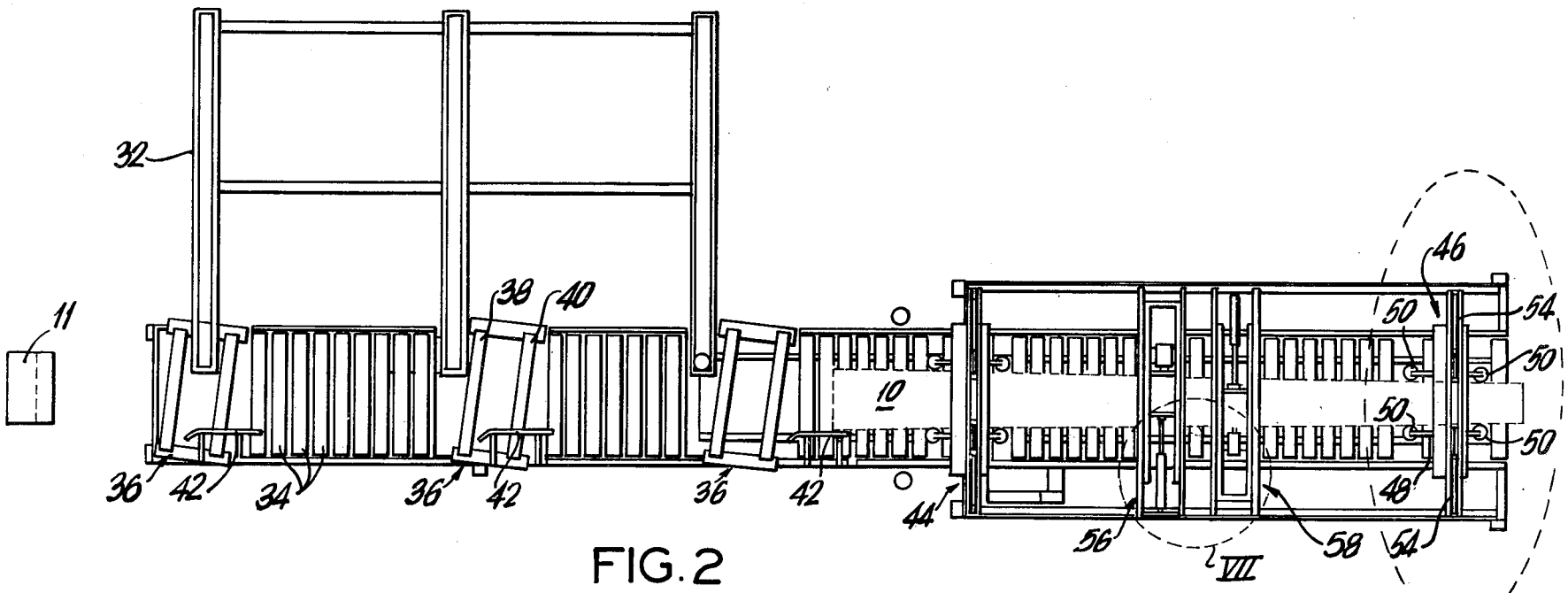
FIG. 2 is a top view of the in-feed section of FIG. 1.

Referring now to the drawing in detail, FIG. 1 shows the apparatus according to the present invention in schematic form. A cant 10 having a profile as indicated in cross-section at the left of FIG. 1, passes through an in-feed section 12 where the cant is centered and limbs removed, into a dryer section 14 having two stages 16 and 18 where the cant is heated by a radial frequency generator with electrodes 20 and 22, to be described later. Suffice it to say here that the electrodes 20 create an electrical field by dielectric means in the cant to heat the moisture therein, while in the second electrodes 22 a concentrated electrical field is applied to the bark area of the cant to produce a gas buildup between the cambium and the bark to cause partial separation of the bark.

From the dryer the cant is fed into a debarking section 24 having three stages. Brushes 26 in the first stage remove loose, large bark pieces. Crusher heads 28 in the second stage loosen, raise and flake the remaining bark without damaging the wood. Finally, brush sections 30 remove loose ends and rough edges and create a smooth finish.

Figure 3:
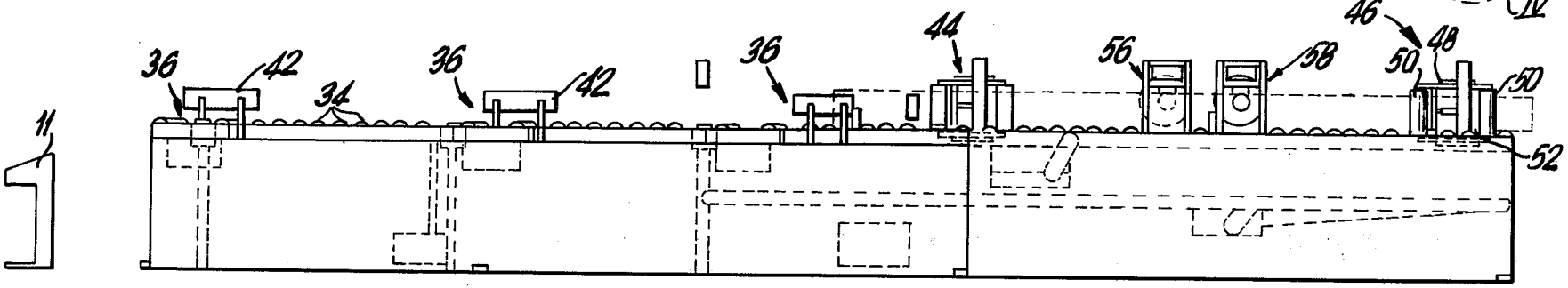
FIG. 3 is a side view of the in-feed section.
Figure 4:
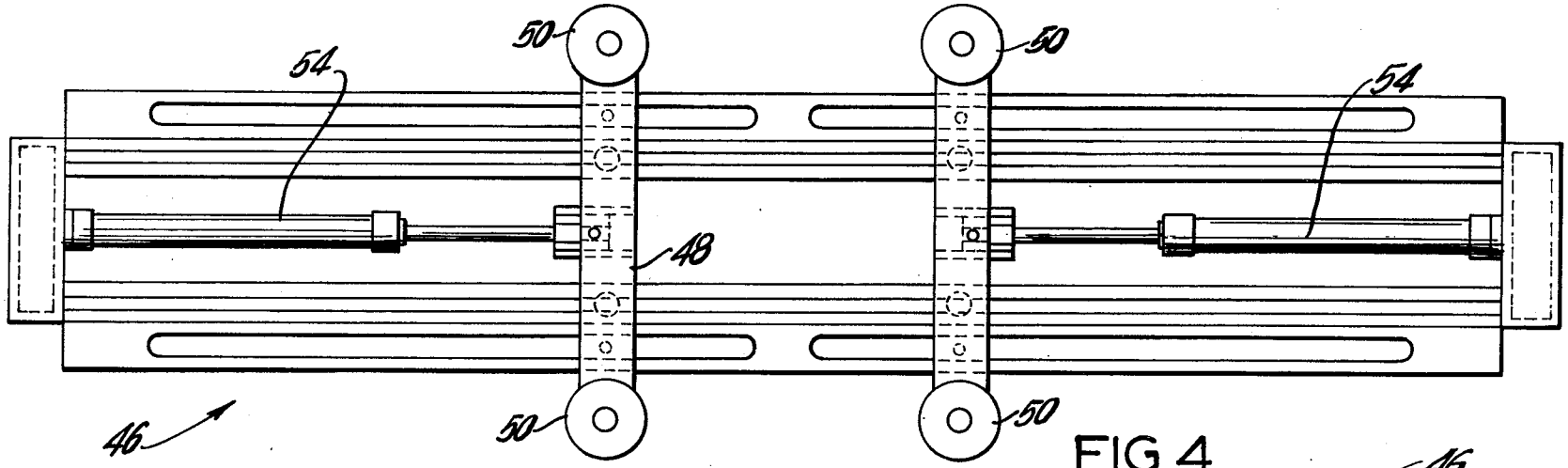
FIG. 4 shows the portion IV encircled in FIG. 2, in greater detail.
Figure 5:
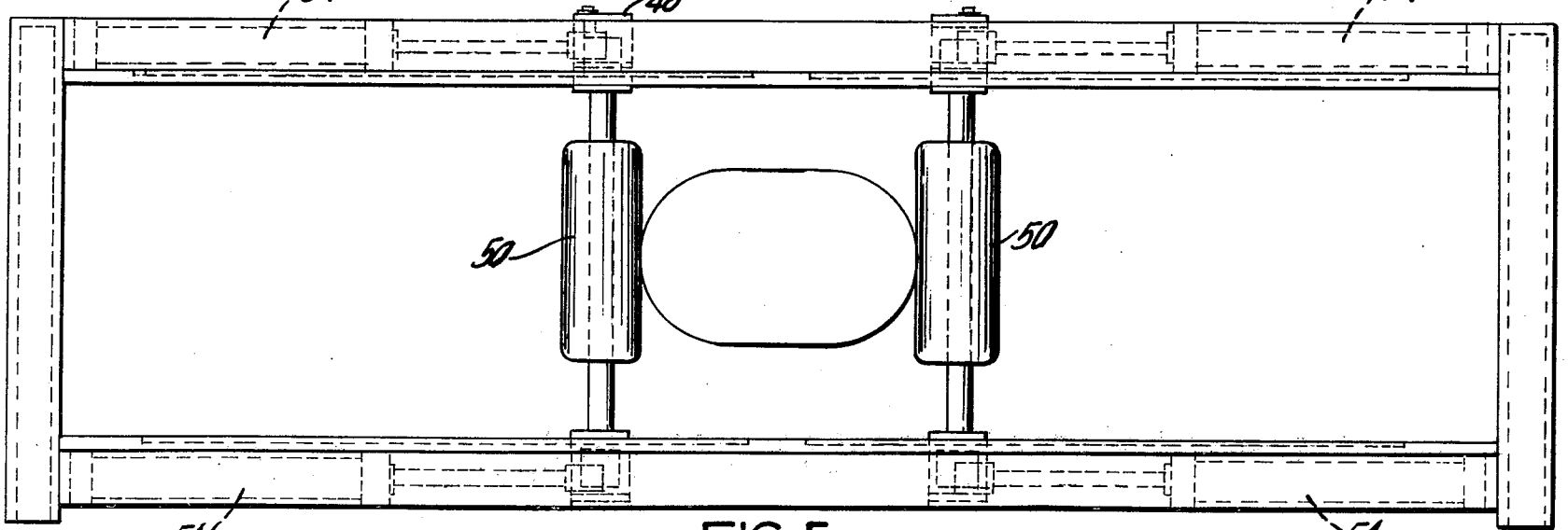
FIG. 5 is a section along the line V—V of FIG. 4.
Figure 6:
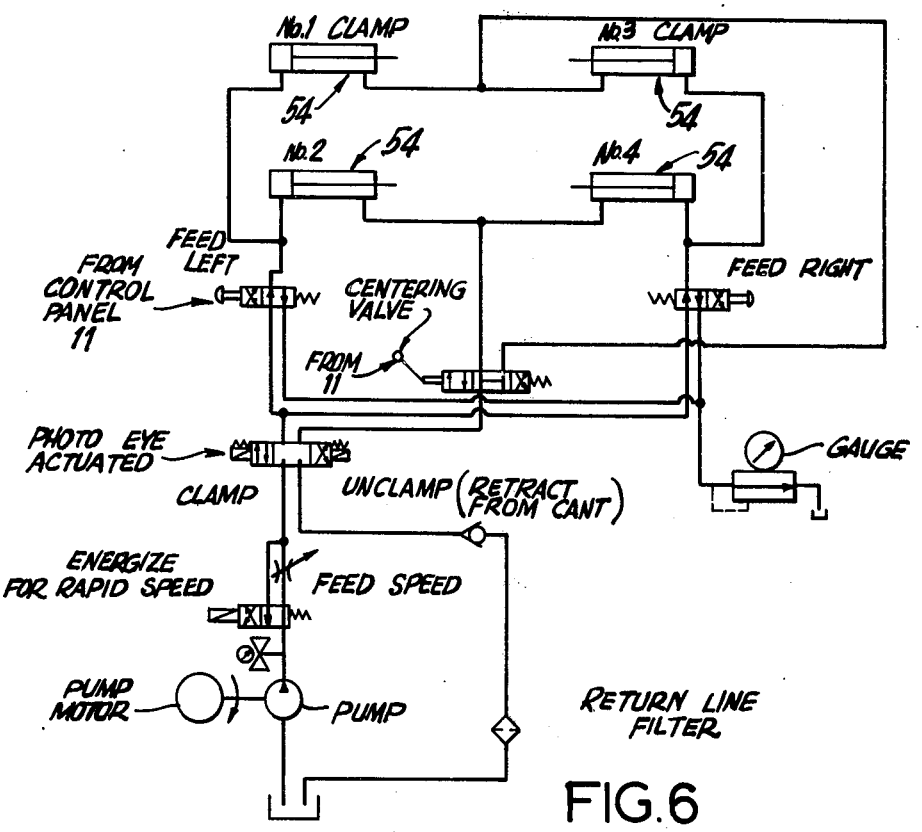
FIG. 6 is a hydraulic circuit for operating the centering head of FIGS. 4 and 5.

FIGS. 2 and 3 illustrate the in-feed section 12 of the machine. The cants 10 are deposited on a chain conveyor 32 of known construction, which is controlled in a conventional manner via photoelectric sensors (not shown) in such a way that only one cant at a time is deposited on a chain-driven conveyor 34. Proper positioning is facilitated by three spaced roll assemblies 36. These are arranged at an angle of 10° to 15° with respect to conveyors 34. Each roll assembly comprises two rollers 38, 40 driven by a motor (not shown) and causes the cants to be deposited against cant locating plates 42 so that the cant is in the proper central position for further processing through the drying and debarking section of the machine.

The proper location is further assured by centering heads 44, 46 which automatically adjust to the width of the cant and move the cant properly centered. Each centering head includes two bars 48, each carrying two vertically extending rollers 50 for direct engagement with the cant. The bars 48 are guided in slotted plates 52 via pins 53 and reciprocable by cylinder piston systems 54.

The hydraulic circuit is lever actuated by the console operator at 11. The specific action he controls is the rapid clamping onto the log, then centering the log into a position which is desirable. However, the circuit is designed that when clamping action is completed, the operator need not be too concerned about centering as the control valves and circuit automatically seek center by equalizing pressures to each hydraulic cylinder - an equal force - so that the actions of the cylinders are then synchronized. Fluid flow is such that if the cant is to either side of center, pressure is exerted to cylinders on the side off center and less pressure to the side closest to center, then as they move closer to true center pressure diminishes on the off center side.

Figure 9:
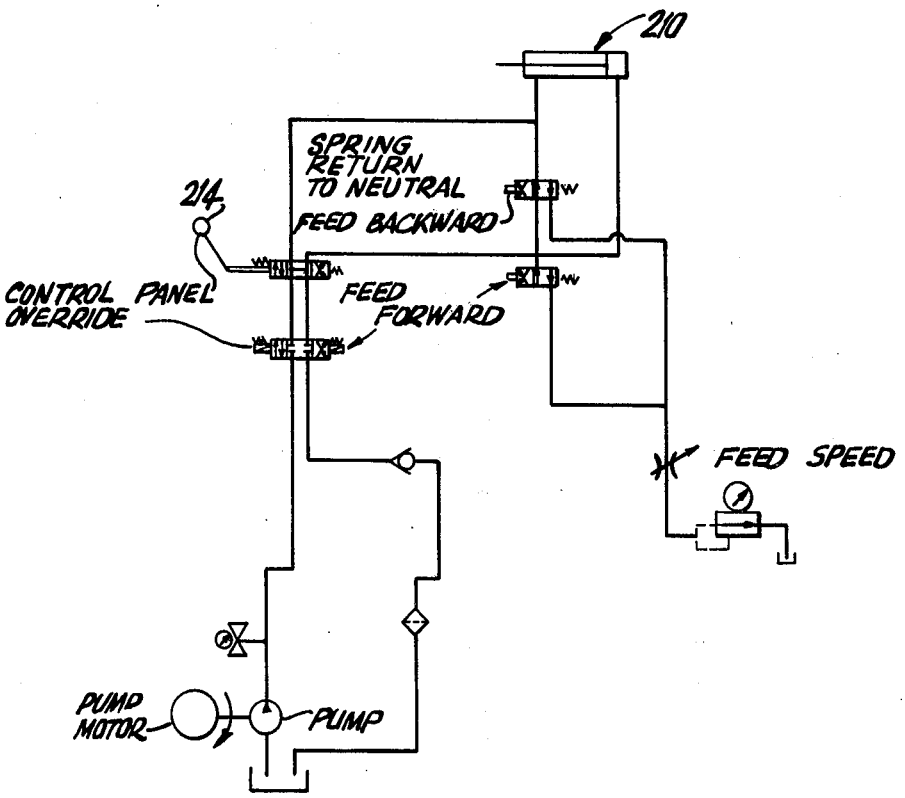
FIG. 9 is a hydraulic circuit for operating the saw of FIGS. 7 and 8.

The centering heads position the cant for trimming off the limb portions protruding from the cant to produce a fairly uniform surface. The actual trimming is accomplished by two powered rotating saw assemblies 56, 58, described in detail further below in connection with FIGS. 7 to 9.

Figure 7:
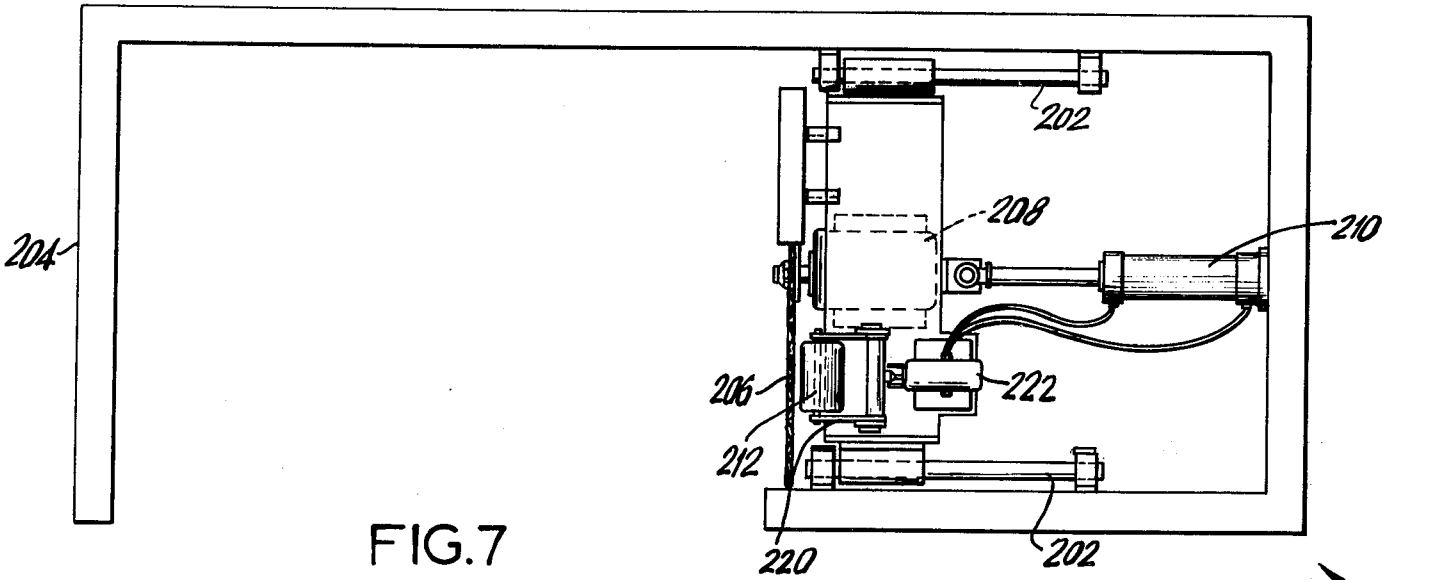
FIG. 7 shows portion VII of FIG. 2, in greater detail.
Figure 8:
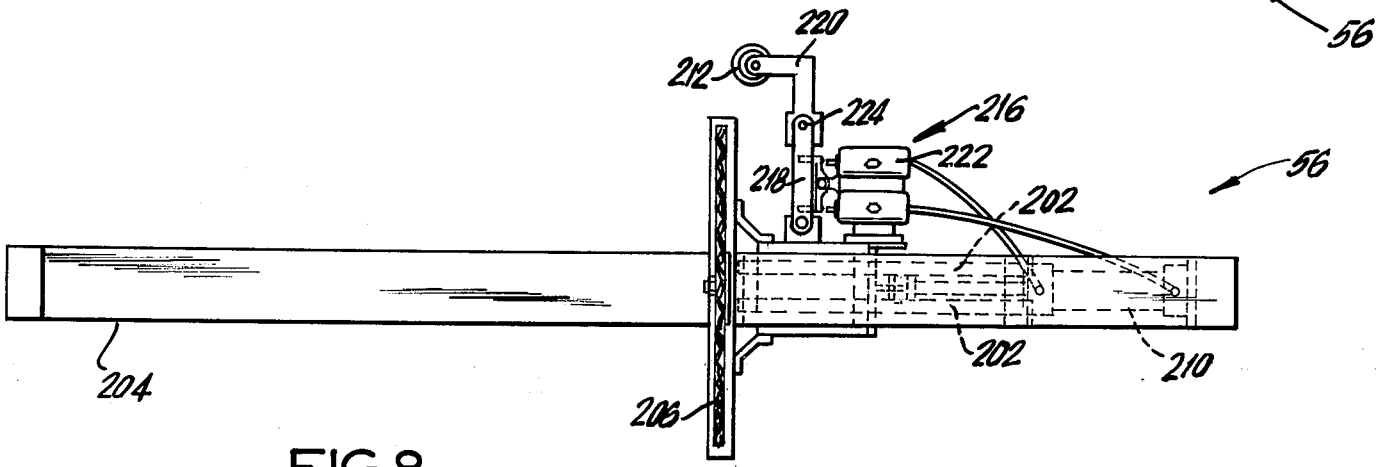
FIG. 8 is a top view of FIG. 7.

Each saw assembly comprises four guides 202, two on each side, one above the other, mounted on a frame 204. The actual saw 206 including drive motor 208 is reciprocable along guides 202 by a cylinder-piston system 210 which is actuated in response to a lead roller 212 sensing the presence of a protruding limb. The saw 206 moves back and forward to adjust to the contour of the log or cant 10 so as to position the saw 206 near (within ¼-½" of) the surface. The movement is controlled by means of a control panel lever 214 and a follower assembly 216. All actuation is hydraulic. The follower assembly 216 is a three piece unit. It comprises a roller 212, two arm units 218, 220. It is attached to a valve assembly 222. The valve has two parts, one for forward and the other for backward motion and actuates the main hydraulic cylinder 210 which moves the saw head 206 backward or forward. The arm 220 is on the in-feed side of the saw assembly. As the cant moves inward it is contacted by the roller 212. On the onset the roller 212 (when no log is near) is slightly off center toward the center of the conveyor so as to strike the cant 10. When this happens the head moves back (away from the cant). The spring loaded valves 222 keep a low pressure on the roller against the cant. This creates a motion which appears to anticipate the width of the log. With this the saw 206 cuts only branch stumps, limbs, undesirable portions, or the like. More specifically, the saw is moved in and out, that is forward and backward, via the hydraulic cylinder 210 shown in FIG. 7. The entire unit is mounted on the conveyor at 56 and 58, as shown, for instance, in FIG. 2. The saw is mounted in such a way that the blade periphery is above the rollers. The movement of the saw is in and out from the center line of the conveyor, or perpendicularly to and above the rollers. FIGS. 7 and 8 show a saw head mounted on a single track, that is FIG. 3 shows the same type of saw on a double track 202. Elements 56 and 58 are mounted with the saw blades opposite each other in order that one saw cuts protruding stumps on one side of the log and the opposite saw cuts the stumps on the other side of the log.

The valve follower is prevented from producing too erratic an action by the stabilizer arm 220 being not rigidly connected to arm 218 but via a slot and pin connection 224.

Figure 10:
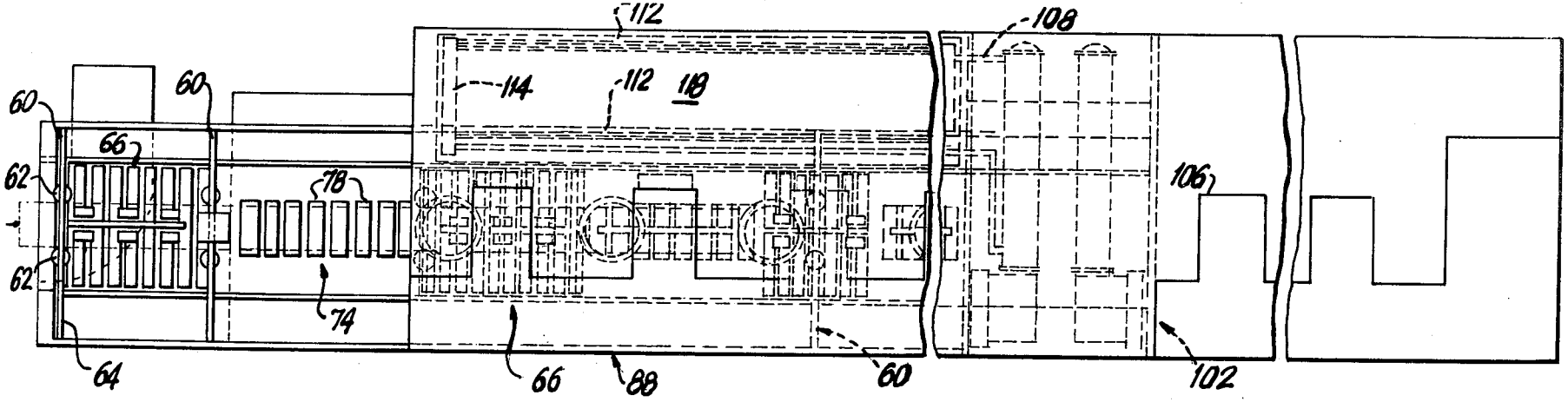
FIG. 10 is a top view of the dryer section of the apparatus.
Figure 11:
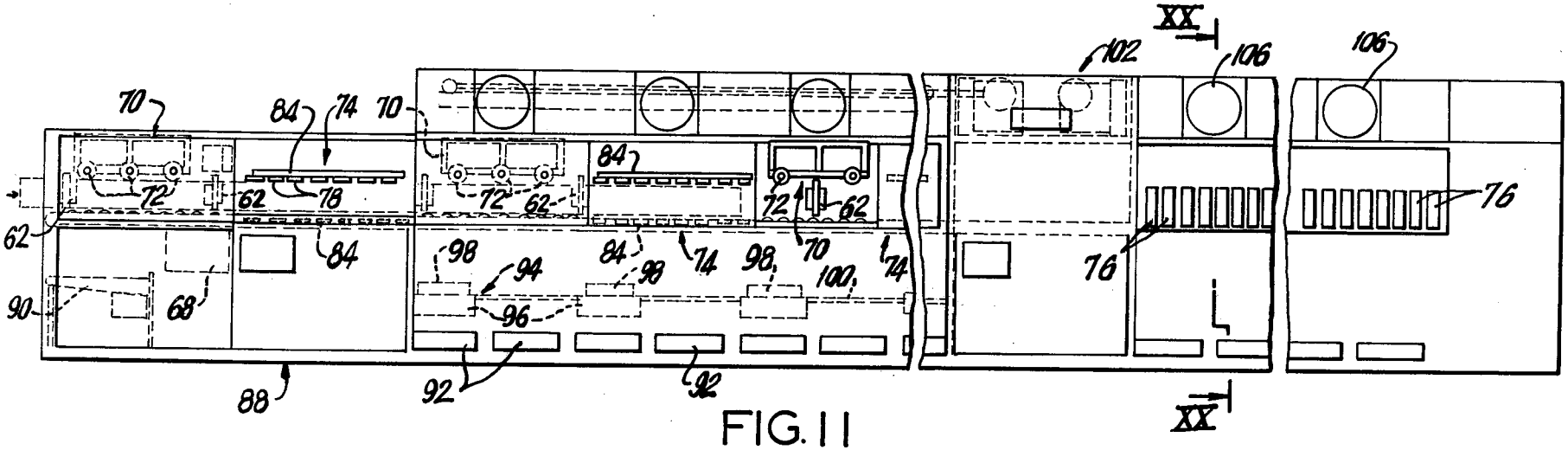
FIG. 11 is a side view of the dryer section.

The thus prepared cant is now fed into the drying section of the machine, illustrated in FIGS. 10 and 11. The drying section consists of two stages 16 and 18, generally indicated in FIG. 1. For a proper operation of the apparatus it is essential that the cant be properly centered in the dryer sections so that it is appropriately spaced from the electrodes to be described later.

Centering is accomplished by eight centering units 60 extending over the length of the dryer section, only four being shown in the left hand portion of FIG. 11. Each comprises two adjustable steel rolls 62 mounted on a rigid track 64. The rolls are actuated by hydraulic cylinders, similar to those shown in connection with the centering heads 44, 46 to adjust the position of the rolls horizontally back and forth until they touch the cant. In addition, the rolls are driven to move the cant forward. In this manner, the cant will be located directly between the electrodes of the dryer section.

The cant is mainly advanced by a series of roller conveyors 66 driven, in a manner known in the art, by a double chain drive (not shown) which in turn is driven by a reversible SCR (selenium controlled rectifier) and power unit 68. An SCR drive is used to insure constant power at varied speed and travel time of the cant through the electrodes, depending on the type of wood and size of the cant. The drive can be reversed to free cants that might have become jammed in the machine for one reason or another.

The machine comprises a number of carriages 70 with hold-down rolls 72 which insure that the cants are held against the conveyor 66 and fix the position of the cant horizontally with respect to the electrodes. It is important that the cants do not touch the electrodes but maintain a spacing of approximately 1 inch from the electrodes and preferably a spacing of between ¼ and ⅛ of an inch.

Figure 12:
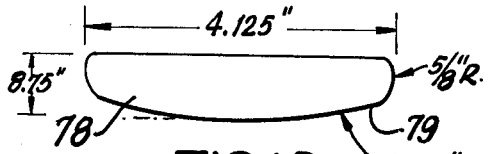
FIG. 12 is a side view of the plate electrode used in the dryer section of FIGS. 10 and 11.
Figure 13:
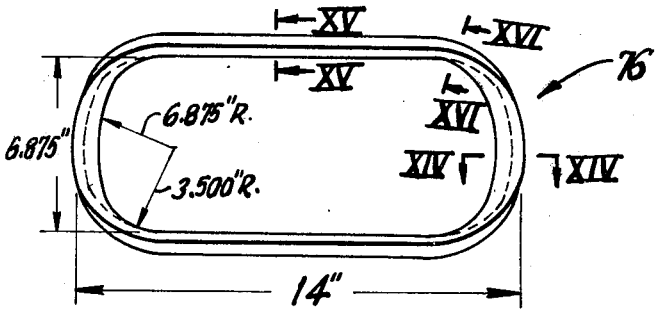
FIG. 13 is a side view of an oval electrode used in the dryer section of FIGS. 10 and 11.
Figure 14:
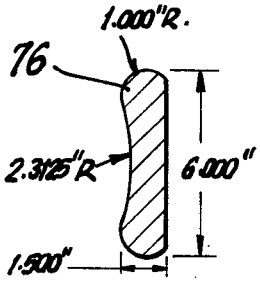
FIGS. 14 to 16 are sections taken along the lines XIV—XIV, XV—XV, and XVI—XVI respectively of FIG. 13.
Figure 15:
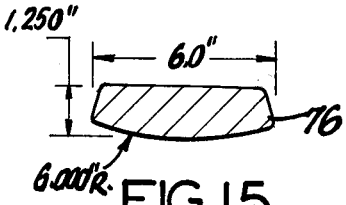
Figure 16:
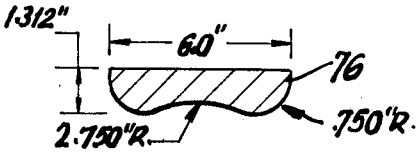
Figure 17:
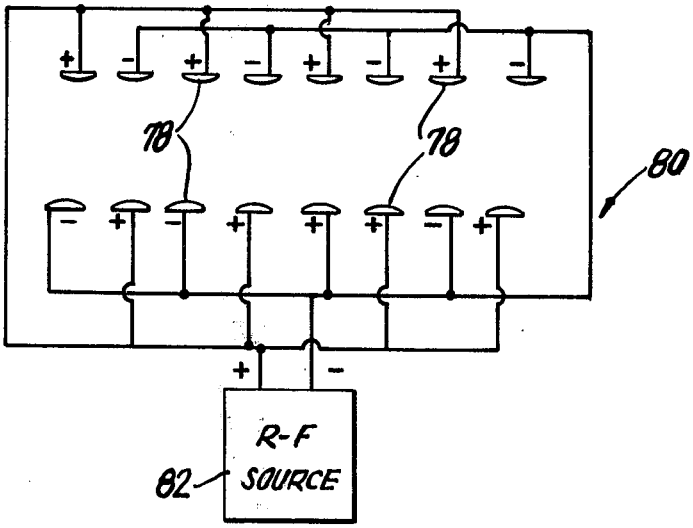
FIG. 17 is a circuit showing the connection of the plate electrode of FIGS. 10 and 12 to the radial frequency generator used in the invention.

The apparatus according to the invention includes two different types of electrodes 74 and 76. The first type comprises a set of plate-like electrodes 78 of aluminum or the like of a generally crown-shaped configuration shown in FIG. 12. The curved side 79 faces the cant concentrating the electric field within the cant and minimizes straying. FIG. 17 illustrates the manner in which the plates of one set are combined in a circuit 80 powered by a Radio Frequency Generator 82, such as a generator manufactured by Reeve Electronics, Inc., Chicago, Ill., with the following characteristics. It is of the vacuum tube type with balanced (3) phase circuit, 28 MHZ and 44OV, 3 phase AC input. The oscillator voltage is controlled to ±3% max. fluctuation. All filaments and plates contain stabilizing circuits. The tubes are water cooled. The plates 78 are held together in spaced relationship to each other by an insulated plate 84 to permit rapid dissipation of moisture liberated by heating the cant.

The reason for removing moisture from a log or cant in stages rather than all at once is to prevent overswelling and/or burning of the log or cant as the drying proceeds. FIGS. 19*a* to 19*d* show a cant in cross-section in various stages throughout its advance through the machine. The cant enters the dryer with the water substantially uniformly distributed throughout (FIG. 19*a*). The plate electrodes 78 of the first dryer section 14 heat the cant and bring it to a vaporization level throughout. Water near the surface to a depth of approximately 2 inches is liberated first. Thereafter water near the center of the cant moves outwardly by so-called hysteresis action and concentrates near the periphery as shown in FIG. 19*b*.

It is the purpose of the first stage to remove only about 10–15% of the free moisture within the cant and control the rate of removal of moisture in such a way that the cant does not burst, swell, char or burn and to prevent breakdown of the wood fiber itself.

The Radio Frequency Generator 82 creates an intensive electrical field of about 28 MHZ and transmits this field via the circuitry shown in FIG. 17 to the electrodes 78. The frequency of 28 MHZ or slightly above has proved most effective. Greatly higher frequencies would remove moisture too fast for most applications. A generator having 30 to 60 KV proves most suitable for drying logs or cants at a productive rate.

Figure 18:
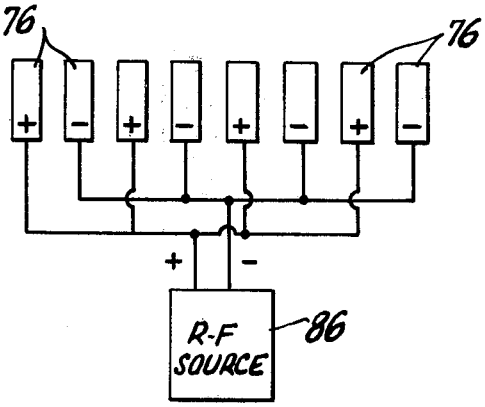
FIG. 18 is a circuit showing the connection of the oval electrode of FIGS. 10 and 13 to 16 to the radial frequency generator used in the invention.
Figure 20:
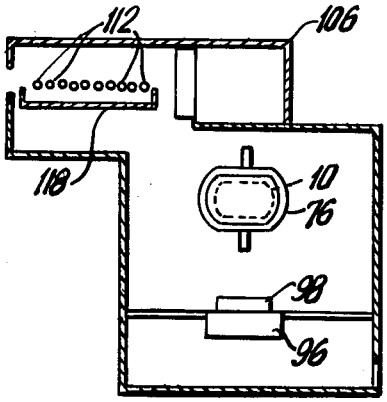
FIG. 20 is a section along lines XX—XX of FIG. 11.

The second dryer stage 18 comprises two sets of oval electrodes 76 connected to a second Radio Frequency Generator 86 via a circuit shown in FIG. 18. Each oval electrode 76, for instance made of aluminum or the like, has a special shape shown in FIGS. 13 to 16 for the purposes to be achieved by it. More specifically, the purpose of the oval electrodes of the second dryer stage is to remove approximately 15% in addition to the moisture removed in the first stage. The oval electrodes will concentrate more of the field onto the circular part of the cant. In the first set of oval electrodes moisture is removed from the peripheral area of the cant (FIG. 19*c*) and the vacated area will gradually be filled with water from the center of the cant so that finally the remaining moisture, approximately 70% of the original camount, is evenly distributed (FIG. 19*d*). It should be understood that the moisture being removed in the two stages is variable within relatively large units. Thus, in the final stage 15 to 20%, and in the second stage about 25%, could be removed.

This second stage 18 might also appropriately be called a bark ionization stage. The concentrated electrical field applied to the bark area of the cant produces a gas buildup between the cambium and the bark, thus creating gas pockets and causing partial separation of the bark from the cant.

The special shape of the oval electrodes in conjunction with the travel rate chosen for the log or cant through the plate and oval electrodes and the KV rating is important in obtaining the desired effects. More specifically, these factors will control the amount of vapor escaping from the bark area. The field effect of the electrodes will break down the gases and will cause the bark to delaminate and the cambium to remain.

The spacing between the sets of oval electrodes, as well as between the plate electrodes, as well as between the plate electrodes sets and between both type of sets allows for proper hysteresis, i.e. movement of water from the interior of the log to the surface area.

It is within the skill of the expert in this field to adjust the travel rate for specific purposes. Thus, if it is desired to increase the amount of moisture to be removed or to achieve total debarking the travel rate will be selected slower so that the cant stays within the electrode areas longer.

It should also be mentioned that the number of stages and number of sets of plate and oval electrodes will be selected according to the desired end result. Thus, if the type of wood dried is denser or if a higher degree of dryness is desired, additional stages could be added.

As an example only, reference should be had to the following table:

TABLE I

NUMBER OF ELECTRODE STAGES AND AMOUNT OF WATER REMOVAL (%) PER TRAVEL PER LENGTH OF STAGE

| Percent of Water Removal | Stages | Length of Stage 1 | Stage 2 | PT/per Min Travel | Avg. Drying Time Min. |
|---|---|---|---|---|---|
| 30–40% | 2 | 16'(16') | 9'(9') | 5.5 | 4.6 |
| 41–49% | 2 | 16'(16') | 9'(9') | 3.8 | 6.5 |
| 50–70% | 4 | 6'(24') | 4'(16') | 5.0 | 8.0 |

( ) indicates total cumulative stage length

The dimensions shown in FIGS. 12 to 16 are given as examples only, namely for a cant having a "diameter" (largest dimension) of 10 to 12 inches, and should not be interpreted as limiting in any way.

Both stages of the dryer section 14 are contained in a combined housing 88. A conveyor 90 at the front end of the dryer and extending at a right angle to the conveyor 66 removes dust, cut sections and debris from the infeed section 12 to prevent the same from entering the drying section and especially the electrodes. Housing 88 is provided with a large number of air intake openings 92 with filters to permit entry of cool and dirt-free air into the dryer section. Hot air blowers 94 are mounted within the housing and have an electrically powered motor and blade fan 96 with electrically heated coils 98 mounted on top of the fan. Warm air of approximately 30° to 40° C. is blown over the electrodes 74 and 76 to remove water vapor created during heating of the cant or log thus preventing the electrodes from accumulating excess amounts of moisture which would otherwise dissipate the electrical field, and to prevent condensation on the electrode.

Housing 88 also contains a vapor barrier 100 in the form of a sheet metal cover for preventing cool air from the bottom area of the dryer section from reaching the electrodes.

A refrigeration unit 102 is provided in housing 88 to cool efficiently the large amount of moisture removed from the cant and blown by blowers 94 into the area above the electrodes. A condenser circuit 104 connected to unit 102 carries water within a temperature range of 4° to 7° C. cooling the surrounding area and condensing the vapor into water. Approximately 60 to 70% of the vapor is condensed and the remaining vapor is blown out via exhaust blowers 106. Water is circulated from the refrigeration unit 102 by means of a pump 103 via an inlet pipe 108 into a header 110 and from there into a series of water pipes 112 extending over the area of the electrodes. Water pipes 112 are provided with radiator fins (not shown) and extend into a header 114. The water is returned via a return pipe 116 to the unit 102. A pan 118 collects the condensed water which is drained off.

The exhaust blowers 106 provide for continuous removal of liberated moisture and radiated heat from the area around the electrodes so that no buildup occurs. The blowers direct the vapors from the area above the electrodes over the cooling pipes 112 for condensation and the noncondensed vapors to the outside.

Figure 22:
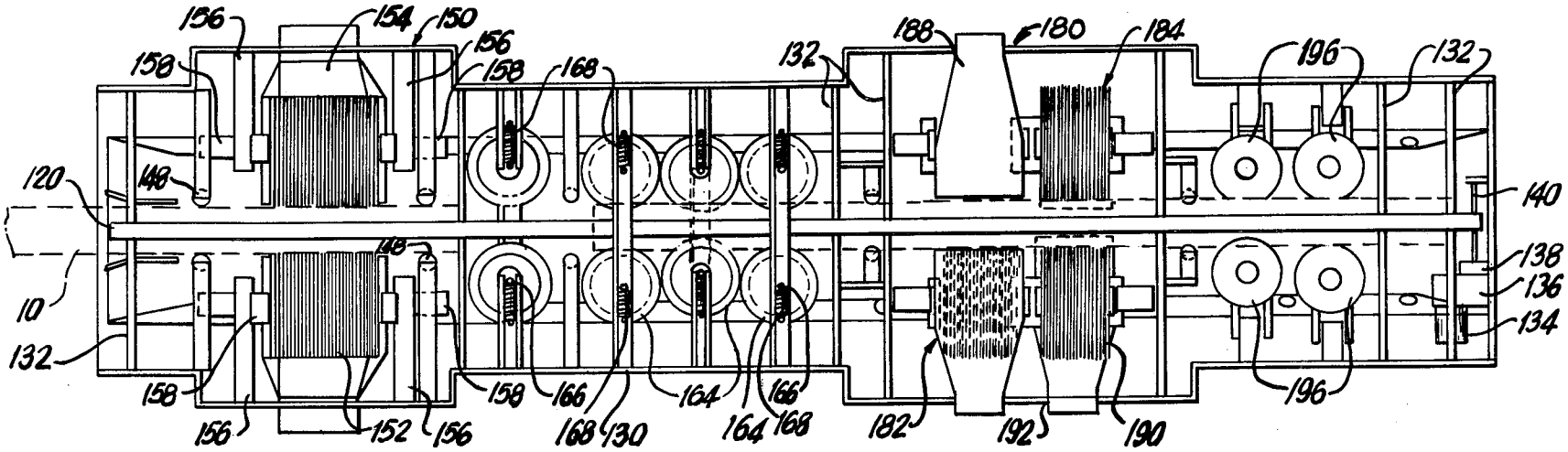
FIGS. 22 and 23 are respectively a top and side view of the debarking section of the apparatus according to the invention.
Figure 23:
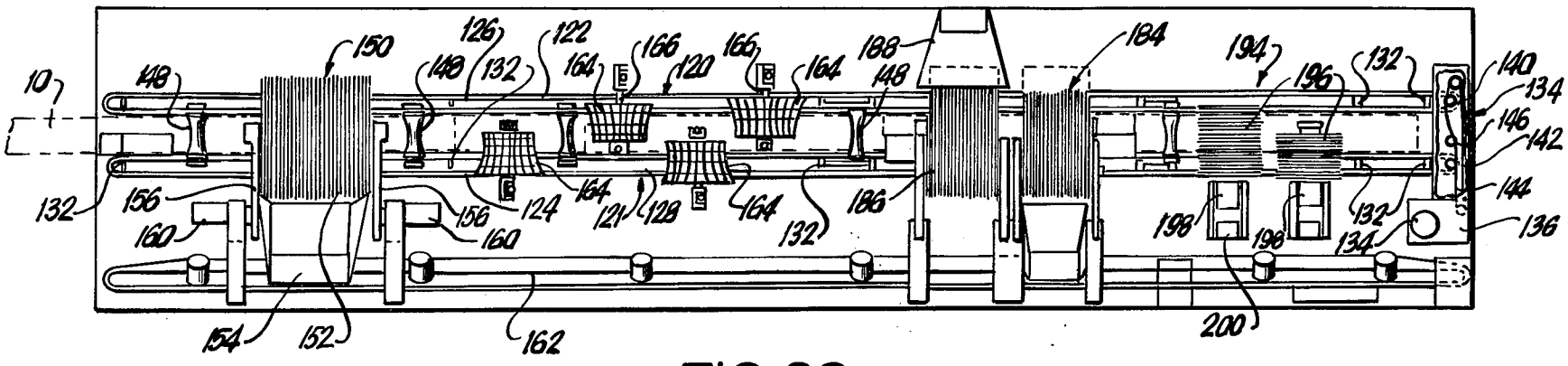

Upon passage through the dryer section the cant 10 enters the debarking section shown in detail in FIGS. 22 and 23. The cant is transported through the section by two conveyors 120, 121, one engaging the top, the other the bottom of the cant. Each conveyor consists of an endless chain 122, 124 respectively rotating on an endless track assembly 126, 128 respectively. The bottom track assembly 128 is rigidly mounted in the frame 130 of the debarking section whereas the top track assembly 126 is adjustable vertically to accommodate cants of different thickness. This is achieved by chain-driven acme screws mounted on track supports 132 extending across frame 130. The conveyors 120, 121 are driven by a motor 134 via a reducer and variable drive 136 and a chain and sprocket assembly 138 including shafts 140, 142, a chain 144 and an idler 146.

The debarking section also comprises a series of conically-shaped hard rubber rolls 148 mounted on a track, similar to the centering heads of the in-feed section, and hydraulic-cylinder units activated to automatically adjust to the width of the cant and to keep the cant properly centered for debarking.

The debarking is accomplished in several stages. A front brushing assembly 150 removes loose, large bark pieces of approximately 1 inch by 1 inch and ⅛ of an inch thick or larger, by means of a steel drum 152 or the like, having a diameter of about 20 inches and provided with stiff bristles of synthetic material 8 inches long and approximately 3/16 of an inch in diameter. The drum rotates downwardly so that brushing is perpendicular to the horizontal movement of the cant. The debarking action was, of course, initiated by the drying operation in the preceding section of the machine.

Bark and dust removed by the brush assembly 150 falls into chutes 154 and is removed by a vacuum blower system (not shown). The brush assembly 150 also comprises up-right arms 156 supporting the shaft 158 of the brush drum 152. The drums are driven by motors (not shown). The arms 156 can pivot about shafts 160 to adjust the brush properly to the width of the cant and make proper contact with the cant at a point about ¼ of an inch inwardly of the extended bristles on the drum. The position of the brush assembly is automatically maintained by means of a lead roller which actuates a hydraulic circuit and cylinder assembly for continuous adjustment. These elements are not shown in the drawing but would be obvious to an expert in the field.

Dust and bark not removed by the vacuum blower system mentioned above is deposited on a belt conveyor 162 of canvas fiber or rubber, and removed.

It is to be understood that the brush assembly 150 removes only part of the bark. Therefore, a second debarking stage is provided with a series of crusher heads 164 mounted on shafts 166 and pressed against the cant by springs 168. In a typical application this spring would exert a pressure of from 90 to 110 pounds per square inch. The special shape and open-web design of the crusher head creates compression and spring-back of the bark. It crushes the bark without damaging the wood and loosens, raises and flakes the bark.

Figure 24:
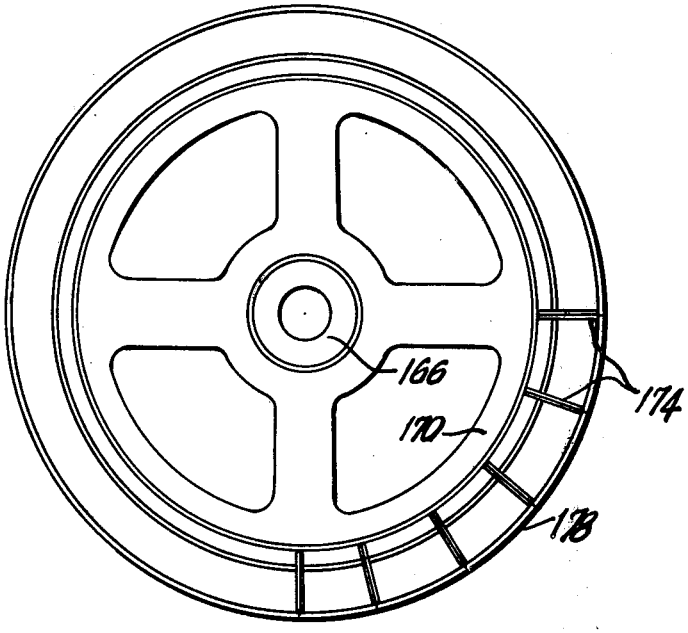
FIGS. 24 and 25 are respectively a top and side view of a crusher head used in the debarking section of FIGS. 22 and 23.
Figure 21:
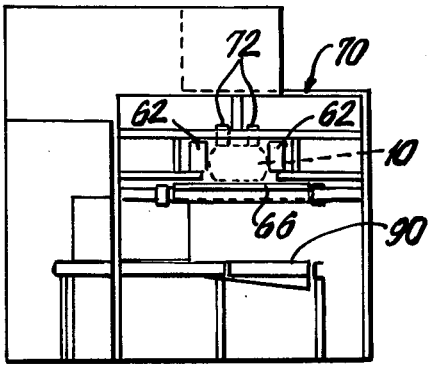
FIG. 21 is an end view of the dryer section as seen in the direction of arrow XI of FIG. 11.
Figure 25:
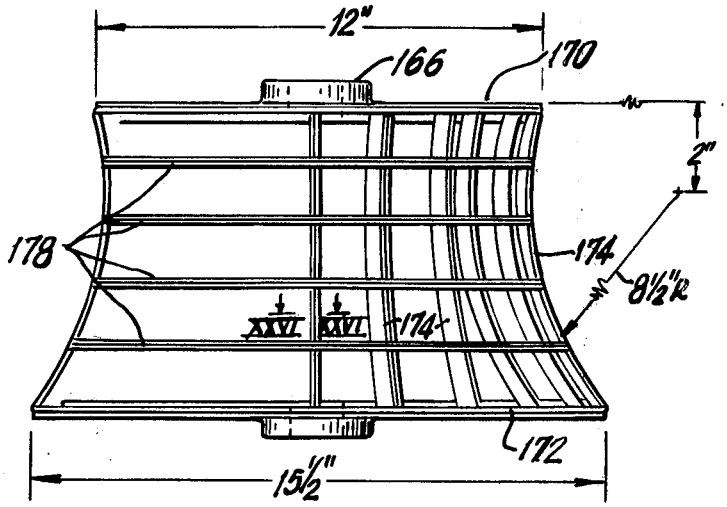
Figure 26:
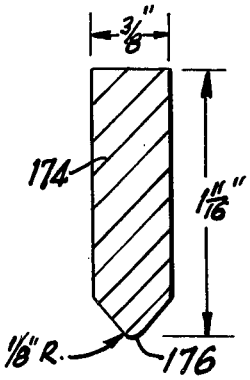
FIG. 26 is a section taken along the line XXVI—XXVI of FIG. 25.

Details of the crusher head are shown in FIGS. 24 to 26. Each crusher head 164 has two hubs 170, 172, one smaller than the other. A series of curved ribs 174 with blunt ends 176 extend radially about the entire periphery of the crusher head (only some being shown in FIGS. 24 and 25) and a series of circumferential ribs 178 provide the required stiffness. Typical dimensions of the crusher head are shown in the drawing, but it should be understood that the same are exemplary only and not in any way limiting.

The loose ends of the flaked bark created by the action of the crusher heads 164 are removed by the third debarking stage 180 comprising a first brush assembly 182 and a second brush assembly 184. Both assemblies are essentially identical to the brush assembly 150, but the bristles flex approximately ½ inch instead of ¼ inch. The brush 186 of assembly 182 rotates upwardly (counter-clockwise) and deposits loose bark and dust in a chute 188 mounted on top of the brush assembly 182. In contrast, the brush 190 of brush assembly 184 rotates downwardly (clockwise) and deposits dust and bark in a chute 192.

Finally, there is a finish brush assembly 194 with four brushes 196, two on each side. One brush on each side is located above and the other below the horizontal center line of the cant. Each brush 196 is driven by a motor 198, such as a 2 Hp, 1800 rpm motor and mounted in a track 200 that can be moved hydraulically. Each brush is provided with nylon bristles that flex ⅔ of an inch, each rotates horizontally, but the brushes on one and the same side rotate in opposite directions, i.e. one clockwise, the other counterclockwise. The finish brush assembly 194 removes rough edges and creates a smooth finish of the cant.

Having thus described the machine according to the invention, the advantages of the invention are many. Among them are: the machine automatically feeds cants for trimming off tree limb portions, produces improved quality of seasoned cant, and debarks in 4 to 6 minutes. It combines many operations into a compact, efficient unit.

It allows for economical pre-processing of cants for storage and improved inventory control, free from fungi, brown stain, checking and warping. The cants can be reprocessed into a finished product at a more suitable time.

The method and machine allows for the processing of structural log type timbers on-line with other sawing and cutting operations without need of kiln drying. It reduces the processing time from days to minutes. It reduces material handling and eliminates a separate debarking operation.

Improved quality of seasoning is obtained as automatic moisture regulation is achieved as the wetter areas absorb more power than the drier areas so that more moisture is automatically driven out of the wet spots. Thus, a cant containing moisture variations will have a much more uniform moisture profile after leaving the dielectric heater section of the machine.

Energy costs are reduced as energy is consumed only in heating water within the cant. There is no heating of surrounding super-structures or surrounding air.

The dryer and debarker of this invention is especially suited for speciality manufacturers in that it allows for seasoning of wood without large space requirement and capital investment in dry kiln operations.

Moreover, it reduces large manpower requirements in manufacturing of log homes by eliminating hand debarking operation, especially for products requiring a special finish on the logs, and where conventional debarking is not suitable.

It is, of course, to be understood that the invention is not limited to the above-described method and apparatus, but that many modifications are possible and contemplated, without departing from the spirit of the invention.

I claim:

1. A method of drying and debarking a log or cant, comprising: passing the log through a first electrical field created by dielectric means and of sufficient strength to heat the moisture in the log or cant and cause the moisture to move outwardly, passing the log or cant through a second electrical field concentrated on the bark to thereby produce a gas buildup of liberated moisture between the cambium and the bark to cause ionization and partial separation of the latter from the cambium, and subjecting the log or cant to a brushing action to thereby remove the bark partially separated by said second electrical field.

2. A method according to claim 1, comprising the additional step of subjecting the log or cant to a crushing action to loosen the bark remaining after subjecting the log to said brushing action.

3. A method of drying and debarking a log or cant in a continuous operation, comprising: passing said log or cant through plate electrodes to thereby subject the log or cant to an electrical field by dielectric means of sufficient strength to heat the moisture therein and cause the moisture to move outwardly, thereafter passing the log or cant through substantially oval electrodes concentrating an electrical field on the bark area of the log or cant to produce a gas buildup therein and cause at least partial separation of the bark from the log or cant, thereafter subjecting the log or cant with its partially separated bark to rotating brushes to at lest partially remove the bark previously partially separated, thereafter subjecting the bark remaining on the log or cant to crushing means to loosen substantially all of the remaining bark from the log or cant; and subjecting the log to additional rotating brushes to thereby create a relatively smooth finish on the debarked log or cant.

4. A method according to claim 3, comprising: accurately centering said log or cant prior to and while passing the same through said plate and oval electrodes, and sawing off protruding limb portions from the log or cant prior to passing the same through said electrodes.

5. An apparatus for drying and debarking a log or cant, comprising first electrode means defining a passage, first energizing means connected to said first electrode means for energizing said first electrode means creating an electrical field in said passage of sufficient strength to heat the moisture within a log or cant passing through said passage and cause the moisture to move outwardly in said log or cant, second electrode means spaced from said first electrode means and defining a second passage, second energizing means connected to said second electrode means for creating an electrical field in said second passage, and debarking means spaced from said first and second electrode means and comprising rotary brushing means arranged adjacent a path in longitudinal extension of said first and second passages and adapted to engage a log or cant passing along said path for removing bark from the log or cant.

6. An apparatus according to claim 5, wherein said debarking means further comprises crushing means arranged adjacent said path and adapted to exert pressure on the bark of a log or cant passing along said path.

7. An apparatus according to claim 6, wherein said crushing means comprises at least one crusher head of basket-like structure having a plurality of circumferentially spaced ribs extending generally in a longitudinal direction with respect to said path.

8. An apparatus according to claim 7, including second rotary brushing means arranged along said path following said crushing means.

9. An apparatus according to claim 8, including finish rotary brushing means arranged along said path following said second rotary brushing means.

* * * * *

UNITED STATES PATENT AND TRADEMARK OFFICE

CERTIFICATE OF CORRECTION

PATENT NO. : 4,148,346

DATED : April 10, 1979

INVENTOR(S) : O. VINCENT SCARNECCHIA

It is certified that error appears in the above-identified patent and that said Letters Patent are hereby corrected as shown below:

Column 9, Line 5, after- "log" insert--or cant--;

Column 9, Line 20, after "log" insert--or cant--;

Column 9, Line 37, after "log" (second occurrence) insert--or cant--.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*